US005465510A

United States Patent [19]

Goodnough et al.

[11] Patent Number: 5,465,510

[45] Date of Patent: Nov. 14, 1995

[54] ROOF RAKE

[76] Inventors: Scott E. Goodnough, 6049 Clinton Ave., S., Minneapolis, Minn. 55419; Thomas F. Moren, 2212 Lakeaires Blvd., White Bear Lake, Minn. 55110

[21] Appl. No.: 225,886

[22] Filed: Apr. 11, 1994

[51] Int. Cl.[6] ..... E01H 5/02

[52] U.S. Cl. ..... 37/285; 294/54.5; 37/265

[58] Field of Search ..... 37/285, 284, 283, 37/278, 265, 266, 434; 294/54.5

[56] References Cited

U.S. PATENT DOCUMENTS

| | | | |
|---|---|---|---|
| 2,598,952 | 6/1952 | Weingart | 37/266 X |
| 2,603,892 | 7/1952 | Fischer | 37/285 X |
| 2,772,490 | 12/1956 | Hnastchenko | 37/284 |
| 3,091,790 | 6/1963 | Schroeder | 37/285 X |
| 3,773,375 | 11/1973 | Nehls | 37/285 X |
| 3,998,486 | 12/1976 | Mittelstadt | 37/285 |
| 4,386,474 | 6/1983 | Mechavich et al. | 37/285 |
| 4,629,203 | 12/1986 | Ballard | 37/265 X |
| 4,865,373 | 9/1989 | Hudson | 37/285 X |
| 5,083,388 | 1/1992 | Cooley | 37/285 X |

OTHER PUBLICATIONS

Brookstone, Hard to Find Tools, Fall 1989 Catalogue p. 9.

*Primary Examiner*—David H. Corbin
*Assistant Examiner*—Victor Batson
*Attorney, Agent, or Firm*—James W. Miller

[57] ABSTRACT

A roof rake includes a generally planar snow moving surface and a handle assembly for manipulating the snow moving surface on the roof. The handle assembly may be gripped by a user who is not located on the roof to pull the snow moving surface from a position on the interior of the roof towards the eaves of the roof to remove a swath of snow. To prevent damage to the roof during this snow removal operation, the lower edge of the snow moving surface is spaced above the surface of the roof by a plurality of rotatable wheels carried on the snow moving surface. One wheel is adjacent each side of the snow moving surface. A plurality of plastic tabs are carried on the lower edge of the snow moving surface. If one of the wheels falls off an edge of the roof, one or more of the plastic tabs will engage the roof to keep the lower edge of the snow moving surface spaced above the surface of the roof.

22 Claims, 1 Drawing Sheet

ROOF RAKE

TECHNICAL FIELD

This invention relates to a roof rake for moving snow from roofs or similar surfaces and, more particularly, to a roof rake having wheels for preventing damage to the roof.

BACKGROUND OF THE INVENTION

In northern climates, snowfall often accumulates in large quantities on the roofs of buildings. The heat in the interior of the building will escape through the attic and the roof, especially if the insulation in the attic is inadequate or the attic is poorly ventilated as is often the case. This heat will melt the bottom of the snow pack on the roof creating a layer of water that runs down the roof to the eaves beneath the snow pack. This water will refreeze along the eaves and create what is known as an "ice dam", namely a long ridge of ice along the eaves protruding upwardly from the eaves.

Such an ice dam is detrimental because it traps melted water behind it. This water will often be forced beneath the shingles on the roof into the interior of the building where it can cause damage to the ceilings or walls of the building. It is obviously expensive to repair such damage. Thus, much time and effort is often spent either removing ice dams from roofs or trying to prevent their creation.

One way of attempting to deal with ice dams is to let them form and then to periodically remove them by thawing or chipping them out. This is a labor intensive process which at the least is inconvenient and difficult to do and can be quite expensive to have done if workmen are hired to do it. In addition, since an ice dam typically adheres to the eaves of the roof very tightly, known methods of removing such ice dams can easily damage the roof itself. Moreover, it can be dangerous to attempt to remove such ice dams as it is often necessary to walk on the roof to do so, giving rise to the possibility of falling off the roof and injuring oneself.

A better method of dealing with ice dams is to prevent their formation in the first place. Various devices have been developed for doing this. For example, electrical heating tape or cords have been used spread in a serpentine fashion along the eaves to create channels in the ice dam to allow drainage of the melted water behind the dams through such channels. In addition to the obvious expense of the electricity required to keep such tape or cords heated, they are not very effective for their intended task. While they may initially create some channels that drain some water, these channels soon ice up rather completely until the tape or cord is itself completely encased in the ice dam with the channels having disappeared.

The most effective way of preventing ice dam formation is to physically remove the snow from those portions of the roof adjacent the eaves, i.e. in a band or strip of the roof beginning at the eaves and extending upwardly for at least a few feet. This is sometimes done by climbing onto the roof and using a shovel to shovel the snow off. This method again can be somewhat dangerous due to the possibility of falling off the roof. In addition, this method is limited to roofs which are fairly easy to climb onto.

A device known as a roof rake has been developed to facilitate removal of the snow from a roof without having to climb onto the roof. This roof rake is used by a person standing on the ground adjacent the building or on a ladder that is propped up against the side of the building. The roof rake typically includes a planar snow moving member having a substantially vertical snow moving face or surface. A long handle assembly is connected to the snow moving member to allow the snow moving member to be held and manipulated by the user. Some roof rakes have various extension members for extending the handle assembly to a total length that may be 20 or 30 feet or even more.

In using a roof rake of this type, the user will hold the handle assembly, which is many feet long, and will raise the snow moving member until it is positioned over the roof and is located a few feet inwardly of the eaves. The user will then allow the snow moving member to drop down onto the surface of the roof. The user will then pull on the handle to move the snow moving member towards him. As this is done, a swath of snow is pulled forwardly by the roof rake over the edge of the roof. The process is then repeated for adjacent swathes until the snow has been cleared from a desired section of the roof.

While roof rakes of the type just described are effective in moving snow from roofs and thus in preventing the formation of ice dams, the Applicants have found that they can damage the surface of the roof. The snow moving surface of the roof rake includes a relatively sharp lower edge that simply directly engages against the roof. As the snow moving member is pulled forwardly during operation of the roof rake, this edge scrapes against the surface of the shingles of the roof, thus scraping off some of the gravel or other particulate material that forms the water repelling face of the shingles. At the conclusion of a winter season in which a roof rake is used on a roof over a number of times, the Applicants have found a layer of this particulate material in the gutters along the eaves.

Obviously, the damage done to a roof by a conventional roof rake is a disadvantage of using such a device. Such damage will eventually cause the roof to leak and damage the interior of the building. At the least, the damage will shorten the life of the roof, requiring it to be replaced earlier than would otherwise have been necessary.

SUMMARY OF THE INVENTION

This invention relates to a roof rake for moving snow from roofs without damaging the surface of the roof. One aspect of this invention is a roof rake which comprises a snow moving member having a snow moving surface that extends upwardly from the roof when the snow moving member is placed on the roof with the snow moving surface being effective for moving a swath of snow off the roof when the snow moving member is moved forwardly from a first position on the roof inwardly of the eaves of the roof towards the eaves of the roof. A handle assembly is affixed to the snow moving member and is sufficiently long to extend outwardly past the eaves of the roof when the snow moving member is placed on the roof in the first position to allow a user who is not located on the roof to pull the snow moving member towards the eaves of the roof. A means is carried on the snow moving member for spacing a lower edge of the snow moving surface above the surface of the roof during forward motion of the snow moving member to prevent the lower edge of the snow moving surface from scraping over the surface of the roof.

BRIEF DESCRIPTION OF THE DRAWINGS

This invention will be described more completely hereafter in the Detailed Description, when taken in conjunction with the following drawings, in which like reference numerals refer to like elements throughout

DETAILED DESCRIPTION

Figure 1:
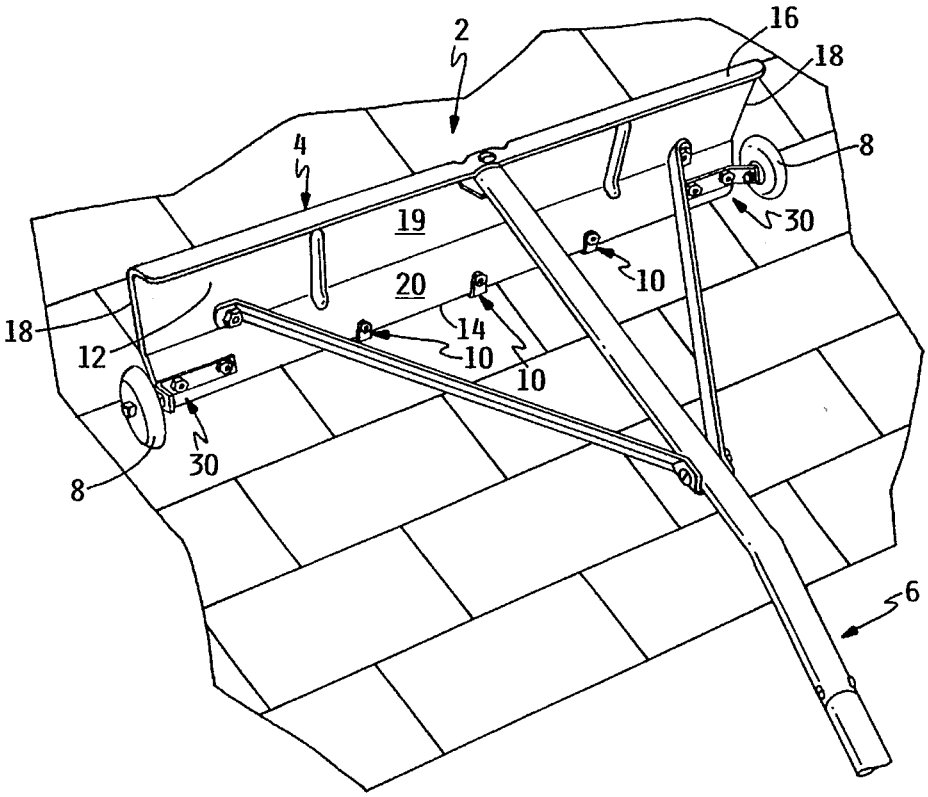
FIG. 1 is a perspective view of a roof rake according to this invention, particularly illustrating the roof rake on the surface of a roof with its lower edge supported above the surface of the roof by side support wheels.

Referring first to FIG. 1, a roof rake according to this invention is illustrated generally as 2. Roof rake 2 is of a generally conventional design comprising a snow moving member 4 and a handle assembly 6 for manipulating snow moving member 4. This invention comprises means for spacing the lower edge of snow moving member 4 slightly above the surface of the roof to prevent damage to the roof during use of roof rake 2. The preferred form of the invention involves both the use of rotatable support wheels 8 and passive spacer tabs 10.

Roof rake 2 includes a snow moving surface 12 that has a lower edge 14, an upper edge 16, and spaced side edges 18, the width of snow moving surface 12 comprising the distance between side edges 18. Snow moving surface 12 comprises a generally planar surface formed from a piece of sheet metal or plastic with lower edge 14 being relatively narrow and relatively sharp. Snow moving surface 12 could be completely planar between its lower and upper edges, or, as shown in FIG. 1, could comprise a vertical top portion 19 and a forwardly inclined bottom portion 20. In either event, i.e. for either a completely planar surface or a surface with some portions that are inclined relative to one another as shown in FIG. 1, snow moving surface 12 is simply considered to comprise an upwardly extending surface that is effective for moving snow.

A handle assembly 6 is secured to snow moving surface 12 and includes an elongated handle tube 22 that is quite long. Handle assembly 6 may also include a plurality of braces 24 and is secured in any suitable manner to snow moving surface 12. For example, as shown in FIG. 1, the inner ends of handle tube 22 and braces 24 are bolted to upper portion 19 of snow moving surface 12. Handle tube 6 will be long enough to extend substantially out past the eaves of the roof so that a user, who is standing on the ground or on a ladder adjacent the eaves, can pull snow moving surface 12 towards him or her and towards the eaves of the roof. As snow moving surface 12 approaches the eaves of the roof, it pushes a swath of snow off the edge of the roof equal to the width of snow moving surface 12.

Roof rakes of the type described herein are generally well known in the art. While the wheels 8 and tabs 10 of this invention have been shown installed on a particular form of roof rake, they are not limited for used with only the roof rake 2 that is shown herein, but can be used with any roof rake having an upwardly extending snow moving surface that is capable of being pulled over the surface of a roof towards the eaves of the roof.

As noted earlier, the improved roof rake of this invention includes a plurality of rotatable support wheels 8 attached adjacent lower edge 14 thereof. As shown in FIG. 1, two such wheels 8 are preferably used, one wheel 8 being located each side edge 18 of snow moving surface 12.

An L-shaped bracket 30 is used to rotatably mount each wheel 8 to snow moving surface 12. One leg 32 of bracket 30 is bolted to snow moving surface 12 generally adjacent lower edge 14 thereof, and the other leg 34 extends longitudinally relative to roof rake 2 to be located slightly outboard of side edge 18 of snow moving surface 12. Wheel 8 is rotatably mounted on this longitudinal leg 34 of bracket 30 in a manner generally well known in the mechanical arts, e.g. by supporting wheel 8 on the shank of a threaded bolt 36 that is itself carried on leg 34 of bracket 30 using a jam nut arrangement (not shown). Washers (not shown) may be used to facilitate rotation of the wheel, and/or a bushing (not shown) may optionally be used between the wheel bore and the shank of the bolt to further facilitate rotation of wheel 8.

The diameter of wheels 8 is chosen in relation to the location of wheels 8 to be sufficient to space lower edge 14 of snow moving surface 12 above the surface of the roof. Thus, as snow moving surface 12 is pulled forwardly towards the eaves of the roof, lower edge 14 of such surface will not scrape or drag along the surface of the roof, i.e. along the surface of the shingles. This will prevent lower edge 14 from scraping off the gravel and other particulate matter that is normally used as the water repellent material located on the face of the shingles. Thus, damage to the roof will be prevented thereby prolonging its life.

Figure 2:
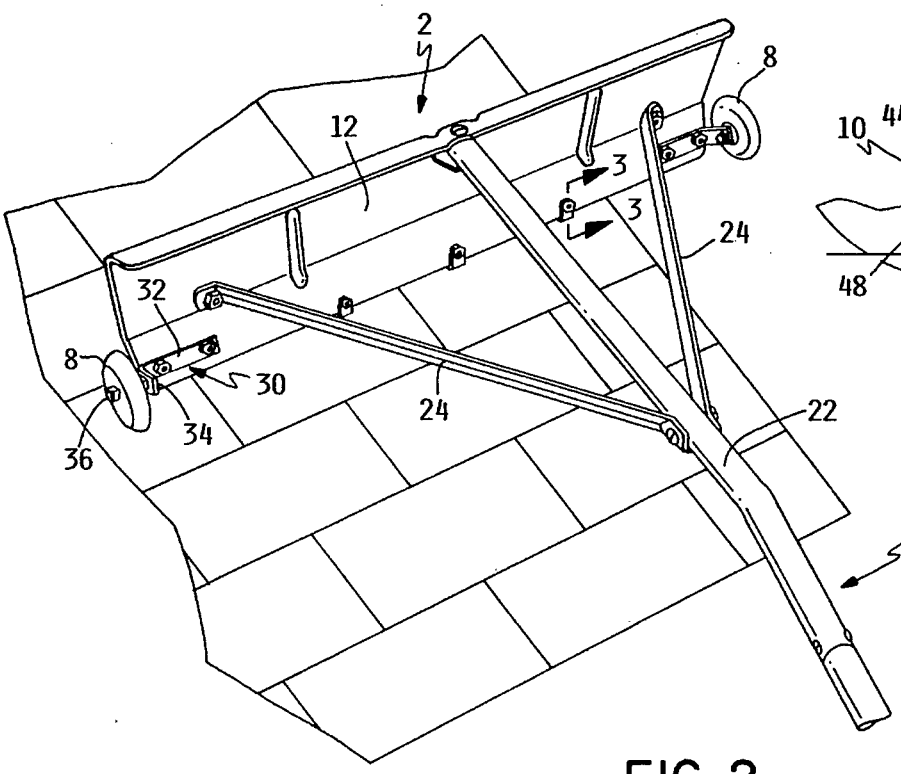
FIG. 2 is a perspective view of the roof rake of FIG. 1, particularly illustrating the roof rake on the surface of the roof with one of the side support wheels being displaced off the edge of the roof and with at least some of the spacer tabs on the lower edge of the roof rake having dropped down into engagement with the surface of the roof.

A roof rake 2 equipped with just support wheels 8 as described above provides advantages over prior art rakes and falls within the scope of this invention. However, in using such a rake, there will be times when one wheel 8 will come over an edge of the roof. This is shown in FIG. 2 where one wheel 8 is shown hanging over one side edge of the roof. This will also happen when roof rake 2 approaches the eaves of the roof and rake 2 is somewhat canted relative to the eaves with one wheel being located lower than the other. In this event, the lowermost wheel will pass over the eaves before the uppermost wheel, again resulting in a situation where one wheel 8 no longer engages the surface of the roof while the other wheel 8 is still on the roof.

When this happens, snow moving surface 12 of rake 2 will tip downwardly to one side towards that wheel 8 that is off the roof. When this happens, that portion of lower edge 14 that is close to that wheel 8 that is off the roof will engage directly against the surface of the roof. Thus, if roof rake 2 is still being pulled forwardly in this tipped orientation, namely forwardly in FIG. 2, some damage could still occur in this situation from the partial engagement that is present between lower edge 14 of snow moving surface 12 and the roof in the area of lower edge 14 that is adjacent the wheel 8 that is off the roof.

Figure 3:
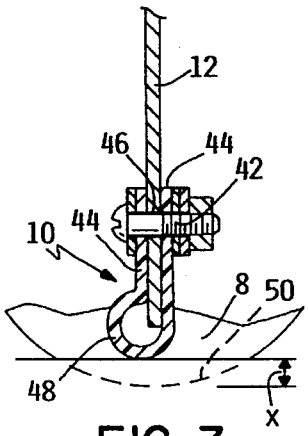
FIG. 3 is a cross-sectional view, taken along lines 3—3 of FIG. 2, of one of the spacer tabs on the lower edge of the roof rake and showing one of the side support wheels having dropped over an edge of the roof.

Thus, in addition to the supporting wheels 8 shown and described herein, a roof rake 2 according to this invention preferably includes passive spacer tabs 10 carried on lower edge 14 of snow moving surface 12 which will come into play when one wheel 8 is off the roof to maintain the spacing of lower edge 14 above the surface of the roof. As shown in FIGS. 1–3, three such spacer tabs 10 are provided spaced apart generally equally along the width of snow moving surface 12. Spacer tabs 10 are preferably formed of a low friction, relatively smooth plastic material, such as nylon or teflon.

Spacer tabs 10 can be secured to lower edge 14 of snow moving surface 12 in any suitable way. As shown in FIG. 3, spacer tabs 10 can be formed of a flexible plastic material that can be bent into a U-shaped configuration to allow each tab 10 to be telescopically received on lower edge 14 of snow moving surface 12. A bolt 42 or other threaded attachment member is used to pass through the spaced legs 44 of tab 10 and through a hole 46 provided in snow moving surface 12 adjacent its lower edge 14 to hold the tabs in place. The lowermost portion 48 of each tab 10 is preferably rounded to enhance its ability to slide over the surface of the roof.

Tabs 10 are preferably positioned to lie above the plane passing through the bottom surfaces 50 of wheels 8. Thus, when both wheels 50 are in engagement with the roof surface, tabs 10 are spaced slightly above the roof surface so as to not engage the same by the distance designated as x in FIG. 3. As noted earlier, tabs 10 come into play only when one wheel 8 passes off the roof and roof rake 2 tips to the side as a result. When this happens, the tab(s) 10 closest to wheel 8 that has passed off the roof will drop down into engagement with the surface of the roof to keep lower edge 14 from dropping down and scraping against the roof. See FIG. 3. Thus, damage to the roof is still prevented even in this situation, even though tabs 10 do not normally ever engage the roof surface when both wheels 8 are on the roof.

Various modifications of this invention will be apparent to those skilled in the art. For example, as already noted, roof rake 2 could be used with or without tabs 10. Thus, the scope of the invention is to be limited only by the appended claims.

We claim:

1. A roof rake for moving snow from roofs, which comprises:

(a) a snow moving member having a snow moving surface that extends upwardly from the roof when the snow moving member is placed on the roof with the snow moving surface being effective for moving a swath of snow off the roof when the snow moving member is moved forwardly from a first position on the roof inwardly of the eaves of the roof towards the eaves of the roof;

(b) a handle assembly affixed to the snow moving member and being sufficiently long to extend outwardly past the eaves of the roof when the snow moving member is placed on the roof in the first position to allow a user who is not located on the roof to pull the snow moving member towards the eaves of the roof;

(c) a pair of wheels rotatably carried on the snow moving member and situated thereon for spacing a lower edge of the snow moving surface above the surface of the roof during forward motion of the snow moving member when the wheels are in engagement with the surface of the roof to prevent the lower edge of the snow moving surface from scraping over the surface of the roof, wherein the wheels are spaced apart relative to one another along the lower edge of the snow moving member; and (d) at least one passive spacer member made of a low friction material fixed to the lower edge of the snow moving surface and having a portion beneath the lower edge of the snow moving surface for contacting the surface of the roof.

2. A roof rake as recited in claim 1, wherein the spacing means comprises means for supporting the snow moving member for rolling over the surface of the roof.

3. A roof rake as recited in claim 2, wherein the supporting means comprises a plurality of wheels rotatably carried on the snow moving member and situated thereon such that the lower edge of the snow moving surface is spaced above the surface of the roof when the wheels are in engagement with the surface of the roof.

4. A roof rake as recited in claim 3, wherein the snow moving member has a predetermined width extending between two spaced apart side edges thereof, and wherein the wheels are spaced apart along the width of the snow moving member.

5. A roof rake as recited in claim 4, wherein two wheels are used on the snow moving member with a single wheel being located adjacent each side edge of the snow moving member.

6. A roof rake as recited in claim 5, further including a bracket for attaching each wheel to the snow moving member such that the wheel is carried slightly exteriorly of the adjacent side edge of the snow moving member.

7. A roof rake as recited in claim 6, wherein the bracket is substantially L-shaped having a first leg attached to the snow moving surface of the snow moving member and a second leg extending at right angles to the first leg and being located slightly exteriorly of the adjacent side edge of the snow moving member, the wheel being rotatably carried on the second leg of the L-shaped bracket.

8. A roof rake as recited in claim 5, further including at least one spacer tab located on the lower edge of the snow moving surface for engaging against the surface of the roof if one of the support wheels falls off an edge of the roof and no longer supports the snow moving member thereon.

9. A roof rake as recited in claim 8, further including a plurality of spacer tabs carried on the lower edge of the snow moving surface with such tabs being spaced apart along the lower edge.

10. A roof rake as recited in claim 9, wherein the spacer tabs are formed of a relatively smooth plastic material.

11. A roof rake as recited in claim 9, wherein the spacer tabs are formed in a U-shape and are telescopically received on the lower edge of the snow moving surface with the lower edge being received in an open end of the U-shaped tab, and further including attachment means passing through the spacer tabs and the lower edge of the snow moving surface for securing the spacer tabs to the lower edge.

12. A roof rake as recited in claim 8, wherein the spacer tab(s) are formed of a relatively smooth plastic material.

13. A roof rake as recited in claim 8, wherein a lowermost point of the spacer tab(s) is positioned to be above a plane defined by the bottom surface of the wheels such that the spacer tab(s) are located above the surface of the roof when both of the wheels are in engagement with the surface of the roof.

14. A roof rake for moving snow from roofs, which comprises:

(a) a snow moving member having a generally planar snow moving surface that extends vertically upwardly from the roof when the snow moving member is placed on the roof with such snow moving surface being effective for moving a swath of snow off the roof when the snow moving member is moved forwardly from a first position on the roof inwardly of the eaves of the roof towards the eaves of the roof;

(b) a handle assembly affixed to the snow moving member and being sufficiently long to extend outwardly past the eaves of the roof when the snow moving member is placed on the roof in its first position to allow a user who is not located on the roof to pull the snow moving member towards the eaves of the roof in a snow removal operation; and (c) first means carried adjacent each side of the snow moving member on the snow moving member for spacing a lower edge of the snow moving surface above the surface of the roof during forward motion of the snow moving member to prevent scraping the lower edge of the snow moving surface over the surface of the roof; and (d) second means carried on the lower edge of the snow moving surface which second means is configured to be located above the surface of the roof when the first means on each side of the snow moving member is in engagement with the roof but will engage against the surface of the roof when one first means on either side of the snow moving member is moved off an edge of the roof while the other first means remains on the roof.

15. A roof rake as recited in claim 14, wherein at least one of the first means and the second means is a rotatable means carried on the snow moving member.

16. A roof rake as recited in claim 14, wherein at least one of the first means and the second means is a passive spacer means fixedly carried on the snow moving member.

17. A roof rake as recited in claim 5, wherein the rotatable means is carried adjacent each side of the snow moving member.

18. A roof rake as recited in claim 17, further including passive spacer means fixedly carried on the lower edge of the snow moving surface which passive spacer means are configured to be located above the surface of the roof when the rotatable means on each side of the snow moving member is in engagement with the roof but will engage against the surface of the roof when one rotatable means on either side of the snow moving member is moved off an edge of the roof while the other rotatable means remains on the roof.

19. A roof rake as recited in claim 18, wherein the passive spacer means comprises a plurality of spacer tabs spaced apart along the lower edge of the snow moving surface.

20. A roof rake for moving snow from roofs, which comprises:

(a) a snow moving member having a generally planar snow moving surface that extends vertically upwardly from the roof when the snow moving member is placed on the roof with such surface being effective for moving a swath of snow off the roof when the snow moving member is moved forwardly from a first position on the roof inwardly of the eaves of the roof towards the eaves of the roof, the snow moving surface having a predetermined width extending between spaced side edges thereof and including a lower edge proximate to the surface of the roof;

(b) a handle assembly affixed to the snow moving member and being sufficiently long to extend outwardly past the eaves of the roof when the snow moving member is placed on the roof in its first position to allow a user who is not located on the roof to pull the snow moving member towards the eaves of the roof in a snow removal operation;

(c) a plurality of wheels rotatably carried on the snow moving member for spacing the lower edge of the snow moving surface above the surface of the roof during forward motion of the snow moving member to prevent scraping the lower edge of the snow moving surface over the surface of the roof and to facilitate forward motion of the snow moving member, wherein one wheel is located adjacent each side edge of the snow moving member; and (d) passive spacer means carried on the lower edge of the snow moving surface, wherein the spacer means extends beneath the lower edge of the snow moving surface but also terminates above a plane extending through a bottom surface of each wheel such that the spacer means is normally positioned above the surface of the roof when both wheels are in engagement with the surface of the roof, whereby the spacer means will engage the surface of the roof when either one of the wheels passes over an edge of the roof and the other wheel remains on the roof such that the snow moving surface tips downwardly towards the wheel which has passed off the roof.

21. A roof rake as recited in claim 20, wherein the spacer means comprises a plurality of tabs telescopically received on the lower edge of the snow moving surface.

22. A roof rake as recited in claim 21, wherein the tabs are spaced apart generally equally along the lower edge of the snow moving surface.

* * * * *